US005460838A

United States Patent [19]

Wermund

[11] Patent Number: 5,460,838

[45] Date of Patent: Oct. 24, 1995

[54] FOOD PACKAGE AND A METHOD OF WRAPPING A FOOD PRODUCT

[75] Inventor: Horst F. Wermund, Holzkirchen, Germany

[73] Assignee: Kraft Jacobs Suchard, Munich, Germany

[21] Appl. No.: 180,747

[22] Filed: Jan. 13, 1994

[51] Int. Cl.[6] ..... B65D 75/00

[52] U.S. Cl. ..... 426/106; 426/123; 383/35

[58] Field of Search ..... 426/106, 123, 426/129, 130, 113; 383/210, 35, 211

[56] References Cited

U.S. PATENT DOCUMENTS

| | | | |
|---|---|---|---|
| 2,189,174 | 2/1940 | Hohl | 426/123 |
| 2,227,236 | 12/1940 | Vogt | 383/210 |
| 2,286,465 | 6/1942 | Clement | 383/35 |
| 3,189,253 | 6/1965 | Mojonnier | 383/35 |
| 4,709,399 | 11/1987 | Sanders | 383/211 |
| 4,866,911 | 9/1989 | Grindrod et al. | 426/129 |
| 4,874,620 | 10/1989 | Mendenhall et al. | 426/113 |
| 4,911,560 | 3/1990 | Hoover et al. | 383/35 |
| 5,036,645 | 8/1991 | Schwarz | 426/123 |
| 5,037,138 | 8/1991 | McClintock et al. | 383/210 |
| 5,077,064 | 12/1991 | Hustad et al. | 426/129 |
| 5,132,124 | 7/1992 | Tamaki et al. | 383/35 |
| 5,348,400 | 9/1994 | Haiss et al. | 383/210 |

FOREIGN PATENT DOCUMENTS

| | | | |
|---|---|---|---|
| 4133959 | 4/1993 | Germany | 383/210 |

*Primary Examiner*—Anthony J. Weier
*Attorney, Agent, or Firm*—Joyce P. Hill; Thomas R. Savoie; Thomas A. Marcoux

[57] ABSTRACT

A comparatively easy to open food package is provided as well as a method of forming or wrapping such food package. The food package, having first and second opposite sections, contains a food product and a wrapping material enclosing the food package. The first section of the food package includes a main portion positioned against the food product and a sealing strip connected to the main portion. The second section includes a main portion positioned against the food product and a flap connected to this main portion. The sealing strip and the flap are pulling means to pull the first and second sections of the wrapping material apart on the first side of the food product.

10 Claims, 4 Drawing Sheets

FOOD PACKAGE AND A METHOD OF WRAPPING A FOOD PRODUCT

BACKGROUND OF THE INVENTION

This invention generally relates to food packages and to a method of wrapping a food package. More specifically, this invention relates to a food package that is comparatively easy to open and to a method of forming or wrapping such a food package.

Many food products are sold in packages that are repeatedly opened and closed by the consumer. For example, cheese is commonly sold in packages containing a number of individual cheese slices hermetically wrapped inside a plastic film or paper-like wrapping material. In use, a consumer opens the package, removes some of the cheese slices, and then recluses the package to help maintain the freshness, taste, and aroma of the slices left in the package.

To open the package, typically the consumer breaks open the wrapping material, usually along a seal or an edge of the wrapping material. It is not always easy to open a package in this way, and often an appreciable force is required to do this. Also, tearing or ripping the package open in this way sometimes results in an untidy appearance; and when the package is opened in this way, it may be difficult to reclose the package in a manner that effectively hermetically reseals the package.

SUMMARY OF THE INVENTION

The present invention relates to a food package comprising a food product and a wrapping material substantially enclosing the food product and including first and second opposite sections connected together on first and second opposite sides of the food product. The first section includes a main portion generally positioned against the food product, and a sealing strip connected to the main portion. The second section includes a main portion generally positioned against the food product, and a flap connected to this main portion. The sealing strip and the flap comprise pulling means to pull the first and second sections of the wrapping material apart on the first side of the food product.

Preferably, the flap is integrally connected to the main portion of the second section of the wrapping material. Also, preferably, the first and second sections of the wrapping material are adapted to be repeatedly pulled apart and re-sealed together on the first side of the food product. This may be done by applying a reusable adhesive to a portion of those sections that are pressed together to close the package.

The food package may be formed by forming a longitudinally extending flap on the outside surface of the central part of a wrapping material, and positioning a food product on the inside surface of that central part, with the wrapping material extending forward and rearward of the food product. The right portion of the wrapping material is folded about the food product and onto a top thereof, and the left portion of the wrapping material is folded about the food product and onto the top thereof. The sealing strip is then formed on top of the food product to connect together the left and right portions of the wrapping material. When the left and right portions of the wrapping material are folded onto the top of the food product, those portions of the wrapping material form a top portion extending forward and rearward of the food product. This top portion is then connected to the central portion of the wrapping material forward and rearward of the food product to enclose the food product in the wrapping material.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
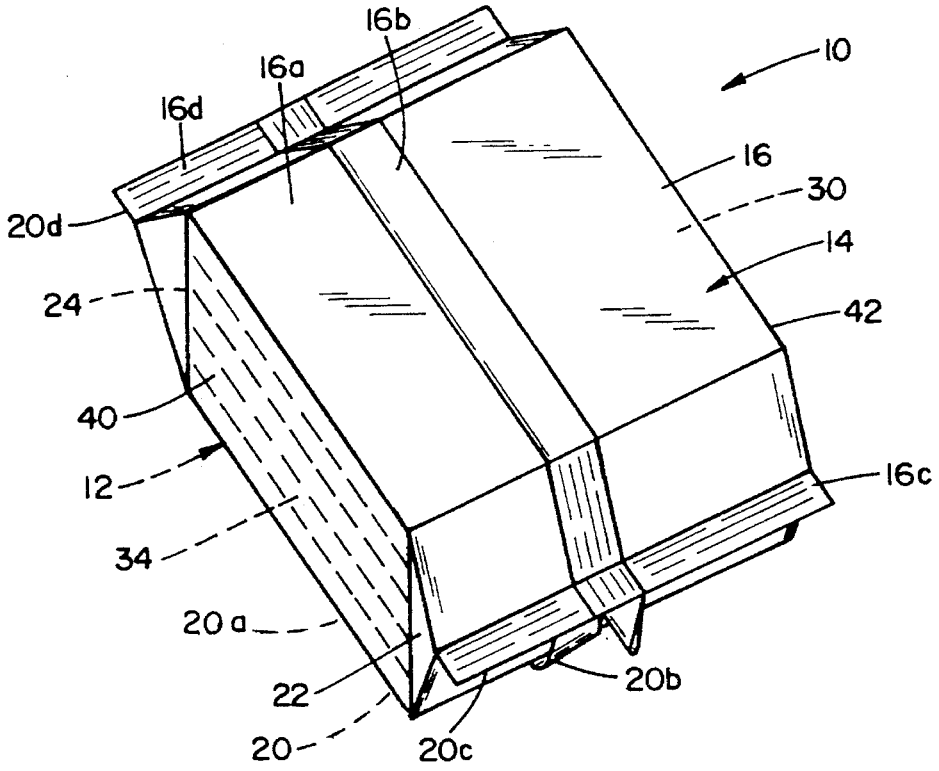
FIG. 1 shows a food package embodying the present invention.
Figure 2:
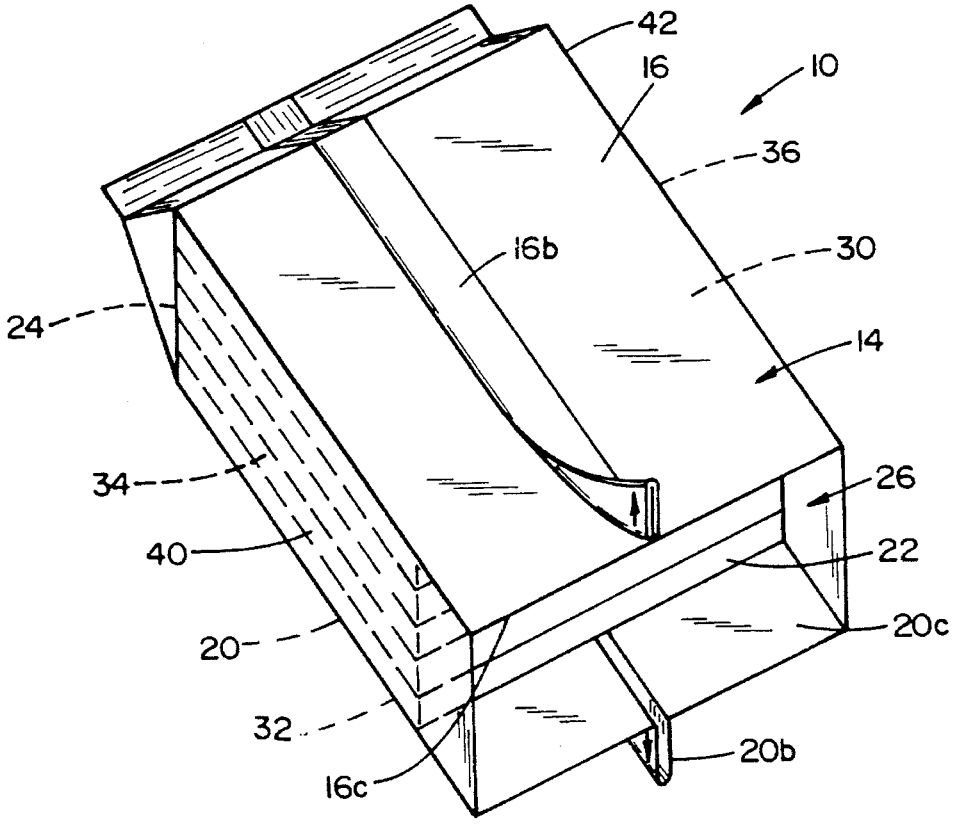
FIG. 2 illustrates the food package after it has been opened.

FIG. 1 shows package 10 comprising food product 12 and wrapping material 14. Generally, wrapping material 14 substantially or completely encloses food product 12, and includes first and second opposite sections 16 and 20 connected together on first and second opposite sides 22 and 24 of the food product. The first section 16 of the wrapping material includes a main portion **16*a* and a sealing strip 16*b* connected to that main portion and located on the outside of the wrapping material. The second section 20 of the wrapping material also includes a main portion 20*a* and a flap 20*b* connected to that main portion and located on the outside of the wrapping material. With reference to FIGS. 1 and 2, sealing strip 16*b* and flap 20*b* comprise pulling means to pull first and second sections 16 and 20 of wrapping material 14 apart on the first side 22 of the food product 10, thereby to form opening 26** in the wrapping material to provide access to the food product.

With the preferred embodiment of package 10 shown in the drawings, flap **20*b* longitudinally extends along and outside of the main portion 20*a* of section 20, and preferably the flap extends from the first side of food product 12 to the second side thereof. In addition, preferably flap 20*b* is integrally connected to the main portion 20*a* of section 20 and is also foldably connected to that main portion for folding movement toward and away from main portion 20*a*. Further, as discussed in greater detail below, preferably flap 20*b* and main portion 20*a* are formed together from the material used to wrap product 12**.

With the preferred embodiment of wrapping material 14, sealing strip **16*b* longitudinally extends along and outside of the main portion 16*a* of section 16, and preferably this strip extends from the first side of food product 12 to the second side thereof. Furthermore, preferably sealing strip 16*b* is parallel to and directly opposite flap 20*b*, and the sealing strip is connected to the main portion 16*a* of section 16 for folding or pivoting movement toward and away from that main portion. Strip 16***a* may be connected to the main portion 16*a* of section 16 in any suitable manner; however, preferably, as discussed in greater detail below, strip 16*b* is formed from overlapping edges of wrapping material 14 as food product 12 is wrapped.

More specifically, with the embodiment of package 10 illustrated in FIG. 1, the above-mentioned first and second sides of food product 12 are, respectively, front and back sides of that product; and the food product further includes top 30, bottom 32, left 34, and right 36 sides. Also, the above-mentioned first and second sections of wrapping material 14 are, respectively, top and bottom sections of that material, and the wrapping material further includes left 40 and right 42 sections. Top and bottom sections 30 and 32 of the wrapping material 14 extend forward and rearward of food product 12 and are connected together both forward and rearward of that food product.

Preferably, top and bottom sections 16 and 20 are connected together forward of food product 12 along contiguous, overlapping panels or panel portions 16*c* and 20*c* having a generally rectangular shape and that laterally extend completely across package 10; and these sections 16 and 20 are also connected together rearward of food product 12 along similar contiguous, rectangularly shaped overlapping panels or panel portions 16*d* and 20*d* that laterally extend completely across package 10. Sections 16 and 20 may be connected together in any suitable way; and for example, a heat seal may be formed across portions 16*c* and 20*c* and 16*d* and 20*d*, or an adhesive may be applied, for example, to portions 16*c* and 16*d* to connect sections 16 and 20 together. Preferably, as discussed in greater detail below, a low strength reusable adhesive is used to connect portions 16*c* and 20*c* together, allowing portions 16*c* and 20*c* to be pulled apart to open package 10 and then reconnected together to reclose the package.

Figure 3:
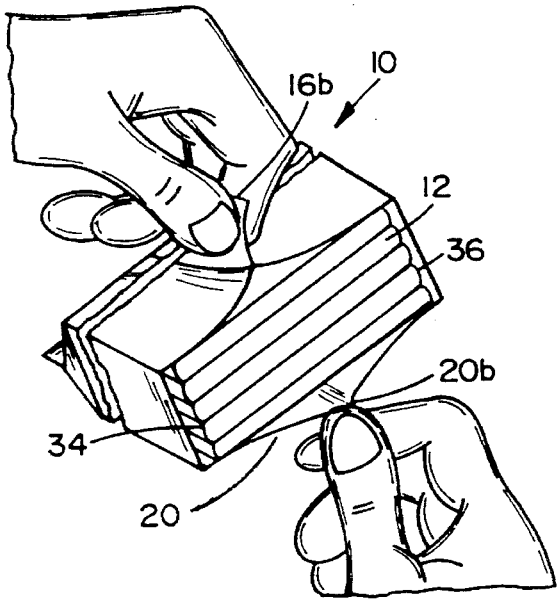
FIG. 3 shows a consumer opening the food package.
Figure 4:
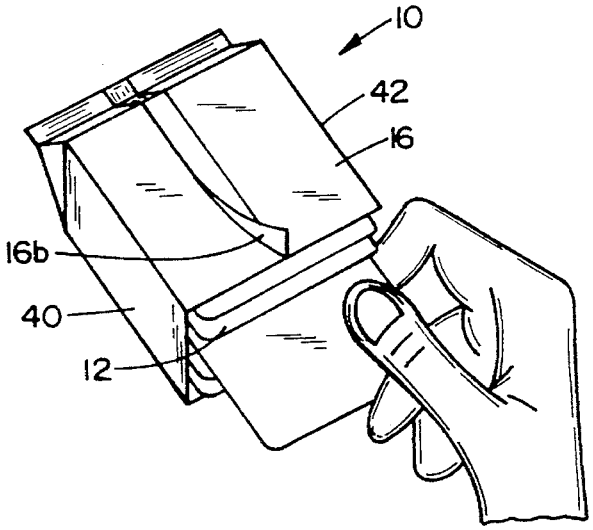
FIG. 4 shows a consumer removing food product from the package.
Figure 5:
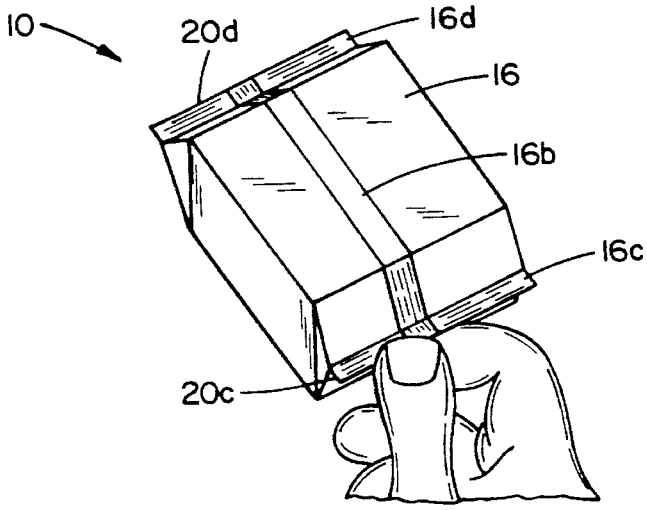
FIG. 5 illustrates how the food package is closed and resealed.
Figure 6:
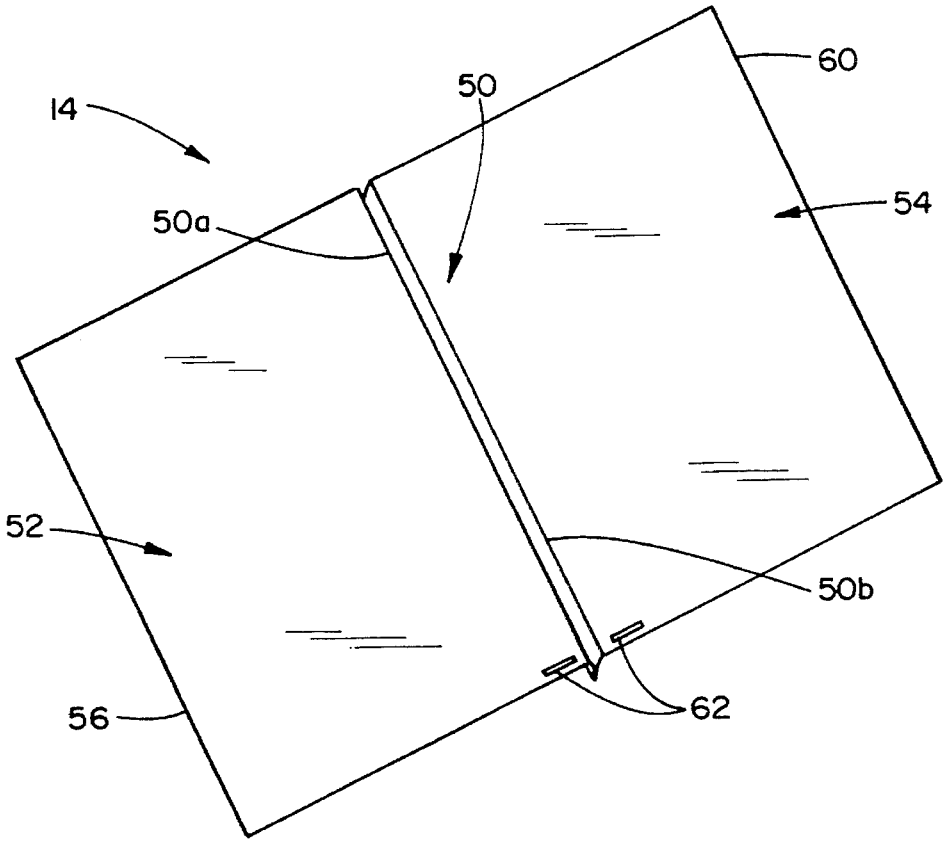
FIG. 6 shows a material that may be used to wrap a food product according to this invention.
Figure 7:
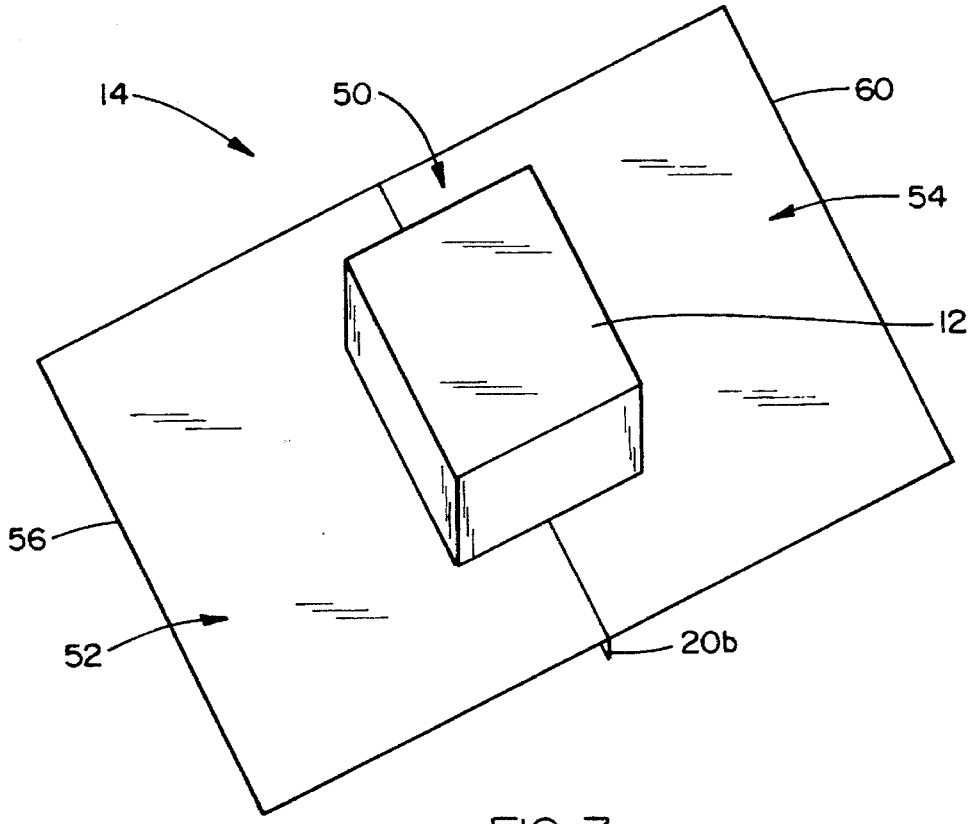
FIG. 7 shows a first stage in a procedure for wrapping a food product according to this invention.
Figure 8:
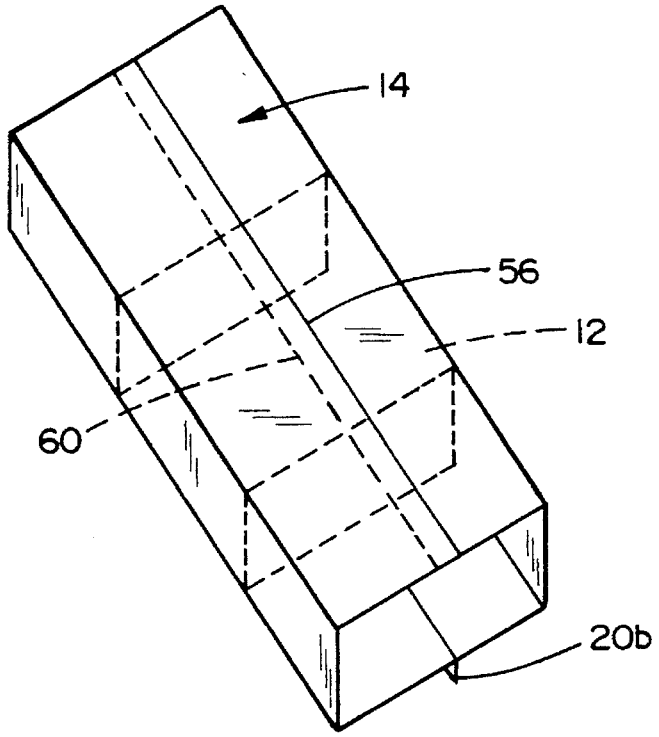
FIG. 8 illustrates an intermediate stage of the wrapping process.
Figure 9:
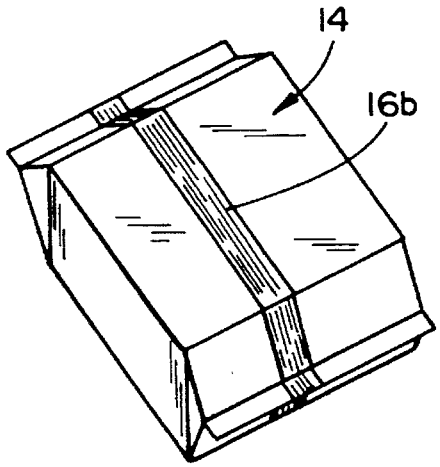
FIG. 9 shows a still later stage of the wrapping process.
Figure 10:
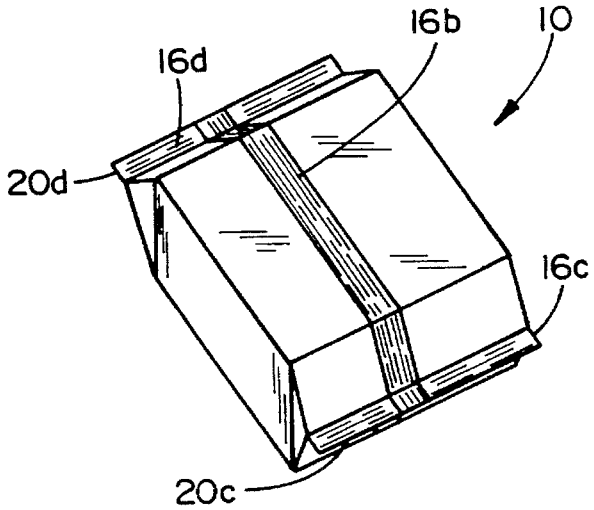
FIG. 10 illustrates the finished wrapped package.

With reference to FIGS. 3–5, to open package 10, a user grips the forward ends of sealing strip 16*b* and flap 20*b* and pulls strip 16*b* and flap 20*b* apart. A relatively moderate force is sufficient to pull portions 16*c* and 20*c* away from each other, and into the open position shown in FIG. 4.

In this open position, top and bottom sections 16 and 20 of wrapping material 14 are spaced apart, as are the left and right sections 40 and 42; and sections 16, 20, 40, and 42 form opening 26 that provides access to food product 12. Once package 10 is opened, the consumer removes the desired amount of the food product and then recloses the package. To reclose package 10, the consumer folds left and right sections 40 and 42 inward and then folds top and bottom sections 16 and 20 toward and into engagement with each other; and in particular, so that opposing surfaces of panel portions 16*c* and 20*c* are brought into engagement with each other. Sections 16 and 20, specifically panel portions 16*c* and 20*c*, are then pressed together, closing and resealing package 10.

The present invention may be employed with many different types of food products. With the specific embodiment of the invention shown in the drawings, food product 12 comprises a multitude of cheese slices that are placed one on top of another to form a stack having a box or cube shape. It should be noted that the present invention may be used with other types of food products, including powder and liquid food products.

Also, packages 10 embodying this invention may have many different sizes and shapes, and in particular, the package may have a pouch shape or an irregular shape. In addition, many suitable wrapping materials are well-known by those of ordinary skill in the art and may be used in the practice of the present invention. For example, wrapping material 14 may be a plastic such as polypropylene.

FIGS. 6–10 illustrate a preferred method or procedure for forming package 10 and in particular, for wrapping food product 12 in wrapping material 14. In the condition shown in FIG. 6, wrapping material 14 has a generally flat shape, including central part 50, left and right parts 52 and 54, and left and right edges 56 and 60.

Generally, package 10 is formed by forming a longitudinally extending flap 20*b* on the outside surface of central part 50, and positioning food product 12 on the inside surface of that central part, with the wrapping material 14 extending forward and rearward of the food product. The left and right parts 52 and 54 of the wrapping material 14 are folded about the food product and onto the top thereof; and the sealing strip 16*b* is formed on top of the food product, extending over the left and right edges of the wrapping material. In particular, the dimensions of wrapping material 14 are selected so that when left and right parts 52 and 54 are folded onto the top of the food product, these left and right edges 56 and 60 overlap slightly on top of the food product. The overlapping left and right edge portions of the wrapping material are then sealed together, forming strip 16*b* and a hermetic seal between those edge portions.

When the left and right parts 52 and 54 of wrapping material 14 are folded onto the top of product 12, those parts 52 and 54 of the wrapping material form top section 16 extending forward and rearward of the food product. To finish wrapping food product 12, top section 16 is connected to central part 50 both forward and rearward of the food product to enclose that product in wrapping material 14.

With reference again to FIG. 6, preferably, flap 20*b* is formed from central part 50 of material 14. This may be done, for example, by overlapping left and right portions of central part 50, or, more specifically, by folding that central part about first and second longitudinally extending parallel fold lines 50*a* and 50*b*.

In addition, in the above-discussed procedure, preferably top section 16 and central part 50 of material 14 are detachably connected together, in a manner that allows section 16 and part 50 to be repeatedly pulled apart and then re-connected and resealed, allowing package 10 to be repeatedly opened and then re-closed and re-sealed.

Any suitable procedure may be employed to connect together section 16 and central part 50 in this way; and, for example, section 16 and part 50 may be connected together by a hot or cold seal along areas that become panel portions 16*c* and 20*c* of wrapping material 14. Section 16 and part 50 may also be connected together by applying a detachable and reattachable adhesive 62 onto an area of wrapping material 14 positioned such that when food product 12 is wrapped in the above-discussed manner, this adhesive detachably connects and holds together top section 16 and central part 50 forward of the food product.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A food package, comprising:

a food product having top, bottom, front and back sides; and a wrapping material forming an interior in which the food product is located, the wrapping material substantially enclosing the food product, and comprised of a single, integral sheet including top and bottom sections connected together forward and rearward of the food product;

the top section including i) a main portion generally positioned against the top side of the food product and extending both forward and rearward thereof, and ii) a sealing strip located outside the interior of the wrapping material and connected to the main portion along a first longitudinal fold line, wherein said sealing strip extends the entire length of said top sections in a direction forward and rearward of said food product;

the bottom section of the sheet including i) a main portion generally positioned against the bottom side of the food product and extending both forward and rearward thereof, and ii) a flap located outside the interior of the wrapping material and connected to the main portion of the bottom section along a second longitudinal fold line, wherein said flap extends entire length of said bottom section;

wherein the first and second fold lines are generally parallel to and opposite each other, the sealing strip is connected to the main portion of the top section, along the first fold line, for folding movement away from the interior of the wrapping material, and the flap is connected to the main portion of the bottom section, along the second fold line, for movement away from the interior of the wrapping material; and wherein the sealing strip and the flap comprise pulling means to pull the top and bottom sections of the wrapping material apart forward of the food product.

2. A food package according to claim 1, wherein:

the sealing strip and the flap are directly opposite each other.

3. A food package according to claim 1, wherein the top and bottom sections are adapted to be repeatedly pulled apart and re-connected together forward of the food product.

4. A food package, comprising:

a food product having top, bottom, left, right, front, and back sides; and a wrapping material enclosing the food product, and comprised of a single, integral sheet including i) a bottom section covering the bottom of the food product, ii) a top section covering the top of the food product;

iii) left and right sections respectively covering the left and right sides of the food product, wherein the top and bottom sections are connected together forward and rearward of the food product to cover the front and back of the food product, iv) a sealing strip connected to an outside surface of the top section along a first longitudinally extending fold line, wherein said sealing strip extends the entire length of said top section in a direction forward and rearward of said food product, and v) a flap connected to an outside surface of the bottom section along a second longitudinally extending fold line, wherein said flap extends the entire length of said bottom section, wherein the first and second fold lines are generally parallel to and opposite each other, the sealing strip is connected to the top section, along the first fold line, for folding movement outward, away from the outside surface of the top section, and the flap is connected to the bottom section, along the second fold line, for folding movement outward, away from the outside surface of the bottom section; and wherein the sealing strip and the flap form pulling means to pull the top and bottom sections apart forward of the food product.

5. A food package according to claim 4, further including adhesive means applied onto at least one of the top and bottom sections forward of the food product to hold the top and bottom sections releasably together forward of the food product.

6. A food package according to claim 5, wherein the flap and the bottom section of the wrapping material are formed together from a central portion of the wrapping material.

7. A food package according to claim 1, wherein:

said integral sheet has first and second longitudinally extending edges; and the sealing strip is formed by overlapping and connecting together said first and second longitudinally extending edges.

8. A food package according to claim 1, wherein:

said integral sheet has a central portion; and the flap is formed by folding a strip of said central portion.

9. A food package according to claim 4, wherein:

said integral sheet has first and second longitudinally extending edges; and the sealing strip is formed by overlapping and connecting together said first and second longitudinally extending edges.

10. A food package according to claim 4, wherein:

said integral sheet has a central portion; and the flap is formed by folding a strip of said central portion.

* * * * *